US010653260B2

(12) United States Patent
Cirri et al.

(10) Patent No.: US 10,653,260 B2
(45) Date of Patent: May 19, 2020

(54) REPOSITORY WITH MECHANISM FOR SHIELDING FROM VIEW AN OBJECT PLACED THEREIN

(71) Applicants: Christopher Cirri, Wallingford, CT (US); David Seales, North Branford, CT (US); Stephen Signore, Wallingford, CT (US)

(72) Inventors: Christopher Cirri, Wallingford, CT (US); David Seales, North Branford, CT (US); Stephen Signore, Wallingford, CT (US)

(73) Assignee: CSS Innovations, LLC, Wallingford, CT (US)

( * ) Notice: Subject to any disclaimer, the term of this patent is extended or adjusted under 35 U.S.C. 154(b) by 302 days.

(21) Appl. No.: 15/432,607

(22) Filed: Feb. 14, 2017

(65) Prior Publication Data

US 2018/0228309 A1 Aug. 16, 2018

(51) Int. Cl.
*A47G 29/12* (2006.01)
*A47G 29/124* (2006.01)

(52) U.S. Cl.
CPC ..... *A47G 29/1209* (2013.01); *A47G 29/1248* (2017.08)

(58) Field of Classification Search
CPC ..... A47G 29/1209; A47G 29/122; A47G 29/1248; A47G 29/141; A47G 29/16; A47G 29/20; A47G 29/22; A47G 2029/148; A63J 21/00
USPC ..... 232/17, 38, 45, 47; 472/71
See application file for complete search history.

(56) References Cited

U.S. PATENT DOCUMENTS 1,456,543 A * 5/1923 Feist ..... A47G 29/121 232/35
1,762,501 A 6/1930 Brehmer
2,579,877 A * 12/1951 Stone ..... A47G 29/1209 232/27
3,735,919 A * 5/1973 Morgan ..... A47G 29/1209 232/17
3,758,027 A * 9/1973 Morgan ..... A47G 29/1209 232/17
4,993,626 A * 2/1991 Berry ..... A47G 29/1209 232/17
5,549,515 A 8/1996 Kondo
5,979,751 A * 11/1999 Maddox ..... A47G 29/1209 232/17
6,234,388 B1 5/2001 Taylor
6,247,642 B1 * 6/2001 Wilson, Jr. ..... A47G 29/1209 232/17
6,375,071 B1 * 4/2002 Kim ..... A47G 29/1209 232/33

(Continued)

*Primary Examiner* — William L Miller
(74) *Attorney, Agent, or Firm* — McCarter & English, LLP

(57) ABSTRACT

Apparatus, systems and methods are provided that include a repository for receipt of an object and a mechanism for shielding from view the object. The repository may take the form of a mailbox and the object may be a letter, e.g., a letter addressed to Santa. The shielding mechanism is actuated by a trigger that is associated with the repository and, in exemplary embodiments, is triggered by an activity normally associated with the repository, e.g., raising a flag on a mailbox. The trigger actuation may interact with an electronic control system, a mechanical control system, or a combination thereof.

20 Claims, 4 Drawing Sheets

(56) References Cited

U.S. PATENT DOCUMENTS

| | | | | |
|---|---|---|---|---|
| 6,644,542 | B2 * | 11/2003 | Cox | A47G 29/16 232/43.1 |
| 6,655,577 | B2 | 12/2003 | Mihaylov et al. | |
| 6,749,519 | B1 | 6/2004 | Hasseler et al. | |
| 7,191,932 | B2 * | 3/2007 | Fobbe | A47G 29/141 232/19 |
| 7,232,056 | B1 | 6/2007 | Jackson | |
| 2004/0133304 | A1 * | 7/2004 | Fobbe | A47G 29/141 700/214 |
| 2004/0140347 | A1 | 7/2004 | Mihaylov | |
| 2004/0195304 | A1 | 10/2004 | Kujawa et al. | |
| 2008/0116253 | A1 | 5/2008 | Gantt | |

* cited by examiner rear front

REPOSITORY WITH MECHANISM FOR SHIELDING FROM VIEW AN OBJECT PLACED THEREIN

BACKGROUND

1. Technical Field

The present disclosure is directed to apparatus, systems and methods that provide a repository for receipt of an object and a mechanism for shielding from view the object. The repository may take the form of a mailbox, although alternative repositories are contemplated. The shielding mechanism is actuated by a trigger that is associated with the repository and, in exemplary embodiments, is triggered by an activity normally associated with the repository, e.g., raising a flag on a mailbox.

2. Background Art

Communications may take various forms. In many instances, communications are posted to a mail service, e.g., using a mail box as the point of communication transfer. Thus, it has long been the case that individuals have been able to address an envelope to a desired recipient, apply appropriate postage, and place the addressed envelope in a mailbox for collection by a mail carrier. To signal the mail carrier that an envelope has been placed in the mailbox, the individual generally raises a flag on the side of the mailbox, i.e., places the flag in a vertical orientation. When the envelope is picked up by the mail carrier, the flag is returned to its non-raised, i.e., horizontal, orientation.

Because a mail box is generally available to and accessible by the public, i.e., the mail box is generally positioned external to a building with the interior of the box available to anyone who opens the mailbox door, efforts have been undertaken to provide security to mail that is delivered to a mailbox by a mail carrier. Thus, for example, U.S. Pat. No. 2,579,877 to Stone discloses a door-actuated dual compartment mail box that includes a swinging platform or shelf that is hingedly mounted and that allows the mail carrier to deposit mail in a receptacle below the platform/shelf. In this way, the deposited mail may be housed in a receptacle beyond reach of the general public. Additional examples of mailboxes that provide security to mail that is deposited therein are set forth in U.S. Pat. No. 6,234,388 to Taylor, U.S. Pat. No. 6,655,577 to Mihaylov et al., U.S. Pat. No. 7,232,056 to Jackson, US Patent Publication No. 2004/0140347 to Mihaylov et al., US Patent Publication No. 2004/0195304 to Kujawa et al., and US Patent Publication No. 2008/0116253 to Gantt.

Beyond the noted efforts in the postal field, various novelty items and/or magic items are disclosed in the patent literature that include mechanisms for shielding view of an object. Thus, for example, U.S. Pat. No. 1,762,501 to Brehmer discloses a "magic card box" that allows surreptitious exchange of one card for another, the appearance of a card in a box that was previously shown as apparently empty and/or for the restoration of a torn card. U.S. Pat. No. 5,549,515 to Kondo discloses a coin-related device that supports magic tricks involving coins. U.S. Pat. No. 6,749,519 to Hasseler et al. discloses an apparatus that includes a hidden compartment and a drawer-based mechanism for selectively exposing/obscuring the hidden compartment.

It is further noted that commercially available products, such as "Elf on the Shelf," are aimed at engaging a child's holiday fantasies and beliefs. However, a need remains for family-friendly products that enhance holiday traditions and contribute to the mysteries of the holiday season.

In addition, despite efforts to date, a need remains for apparatus, systems and methods that function to automatically shield from view an object placed in an enclosure, e.g., a mailbox. A need further remains for a shielding apparatus, system and method that is triggered to shield an object from view based on the user's interaction therewith in a conventional manner. Still further, a need remains for a shielding apparatus, system and method that allows a further object, e.g., a responsive communication, to be introduced thereto in a non-observed manner. These and other needs are satisfied by the apparatus, systems and methods described herein.

SUMMARY

The present disclosure provides apparatus, systems and methods that define a repository for receipt of an object, e.g., a letter, and a mechanism for shielding from view the object/letter. The repository may take the form of a mailbox, although alternative repositories are contemplated. The shielding mechanism is generally actuated by a trigger that is associated with the repository and, in exemplary embodiments, is actuated by a triggering activity normally associated with the repository, e.g., raising a flag on a mailbox.

In exemplary embodiments of the present disclosure, the disclosed apparatus, system and method advantageously encourages interaction of young children and parents during the Christmas season. The disclosed apparatus/system may take the form of a scale model mailbox with built in mechanisms that allow the device to give the illusion of a letter written to Santa "magically" being delivered to the North Pole, i.e., disappearing when placed within a mailbox/repository. The illusion is advantageously triggered once a child has placed a letter to Santa in the disclosed mailbox/repository, e.g., based on the child raising a flag on the exterior of the mailbox/repository.

The disclosed apparatus, systems and methods generally include mechanism(s) and/or interlock(s) that function to prevent the child from discovering the methods used to provide the illusion. In further exemplary embodiments, a children's illustrated book coinciding with use of the disclosed mailbox/repository may be provided to explain the purpose and function of the apparatus/system and how it encourages repeated use and interaction with parent(s) and others throughout the holiday season.

In further exemplary embodiments of the present disclosure, the mailbox/repository facilitates introduction of an object/letter for automatic appearance within the repository after the shielding mechanism is actuated, thereby furthering the illusion that the child is in communication with Santa (or his elves). For example, the mailbox/repository may include an access slot or other opening that permits introduction of a responsive letter. The access slot/opening may be aligned with the shielding mechanism such that the responsive letter is automatically positioned for "appearance" in conjunction with the shielding mechanism moving between an undeployed and a deployed position or orientation.

Of note, the disclosed shielding mechanism may be triggered in various ways. For example, the shielding mechanism may be electronically controlled/actuated, e.g., by way of a solenoid or other electronically-activated triggering element. Alternatively, the shielding mechanism may be mechanically controlled/actuated, e.g., by way of a cam mechanism or the like. Still further, the shielding mechanism may be controlled/actuated by a combination of mechanical and electrical mechanisms, e.g., a mechanical mechanism may be engaged to actuate an electronic mechanism, or vice versa. Regardless of the design and operation of the shielding mechanism and associated triggering actuator, the function of such mechanism(s)/element(s) according to the present disclosure is to automatically obscure from view an object/letter positioned within a repository, e.g., a mailbox, in support of an illusion as described herein.

Additional features, functions and benefits of the disclosed apparatus, systems and methods of the present disclosure will be apparent from the detailed description which follows, particularly when read in conjunction with the accompanying figures.

BRIEF DESCRIPTION OF THE DRAWINGS

To assist those of ordinary skill in the art in making and using the disclosed apparatus, systems and methods, reference is made to the accompanying figures, wherein.

DESCRIPTION OF EXEMPLARY EMBODIMENTS

Repositories for receipt of an object, e.g., a letter, that further an illusion related to disappearance of the letter (and potential appearance of a responsive letter) are provided herein. Although the present disclosure is described with reference to exemplary mailbox implementations, the present disclosure is not limited by or to such mailbox implementations. Rather, the disclosed apparatus, systems and methods may be advantageously employed in other contexts, e.g., for delivery of lost teeth to the tooth fairy, thereby advancing further family-inspired mysteries. Thus, as will be apparent to persons skilled in the art, the disclosed repository/shielding mechanism assemblies have broad application.

Figure 1:
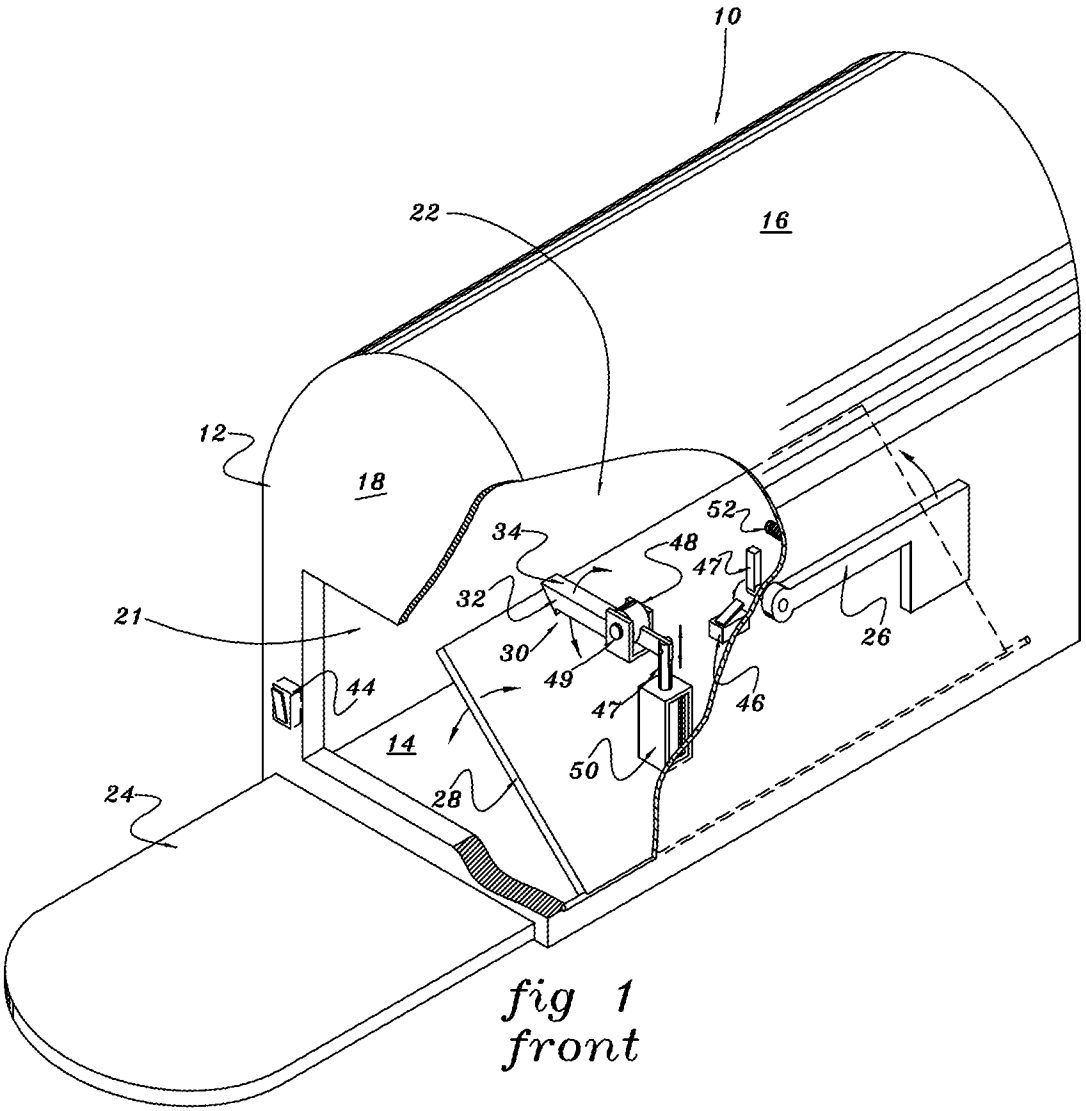
FIG. 1 is a front view isometric drawing of an exemplary mailbox, with a portion of the outer mailbox repository removed to permit viewing of internal elements, according to the present disclosure.

In exemplary embodiments of the present disclosure, a mechanism is provided for shielding from view an object/letter placed within the repository. With reference to FIGS. 1-6, an exemplary mailbox 10 is provided according to the present disclosure. Mailbox 10 includes a mailbox housing 12 that is defined by a base 14, a curved top face 16, a partial front wall 18 and a rear wall 20. The partial front wall 18 defines an opening 21 that is configured and dimensioned to allow introduction/withdrawal of object(s), e.g., letter(s), relative to an internal volume 22 defined by housing 12. A door 24 is hingedly mounted relative to housing 12 and is movable between an open position (as shown in FIG. 1) and a closed position wherein the door 24 is in abutting relation to partial front wall 18. A flag 26 is pivotally mounted with respect to an external surface of curved top face 16 of housing 12.

The disclosed mailbox 10 includes a shielding mechanism that functions to obscure from view an object, e.g., letter, placed in internal volume 22 by a user. In the exemplary embodiment of FIGS. 1 and 2, the shielding mechanism is electronically controlled/triggered. More particularly, a false floor 28 is movably mounted within internal volume 22. In its initial non-deployed orientation, false floor or flap 28 is positioned in a substantially vertical orientation along an inner side wall of curved top face 16. False floor 28 is releasably maintained in its non-deployed orientation by a latch mechanism 30 that includes a latching finger 32 and a latching arm 34. Thus, latching finger 32 engages a top edge of false floor 28 to initially maintain false floor 28 in its non-deployed orientation.

Figure 2:
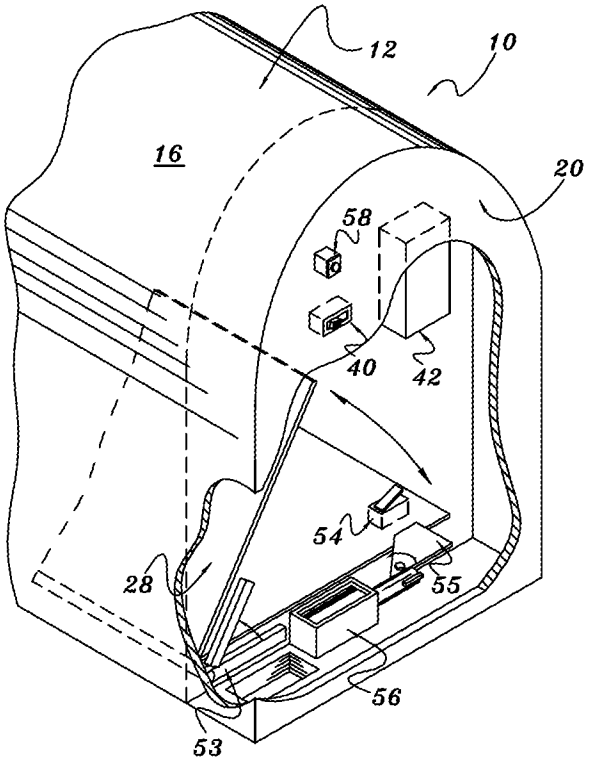
FIG. 2 is a rear view isometric of the mailbox of FIG. 1, with a portion of the outer mailbox repository removed to permit viewing of internal elements, according to the present disclosure.
Figure 3:
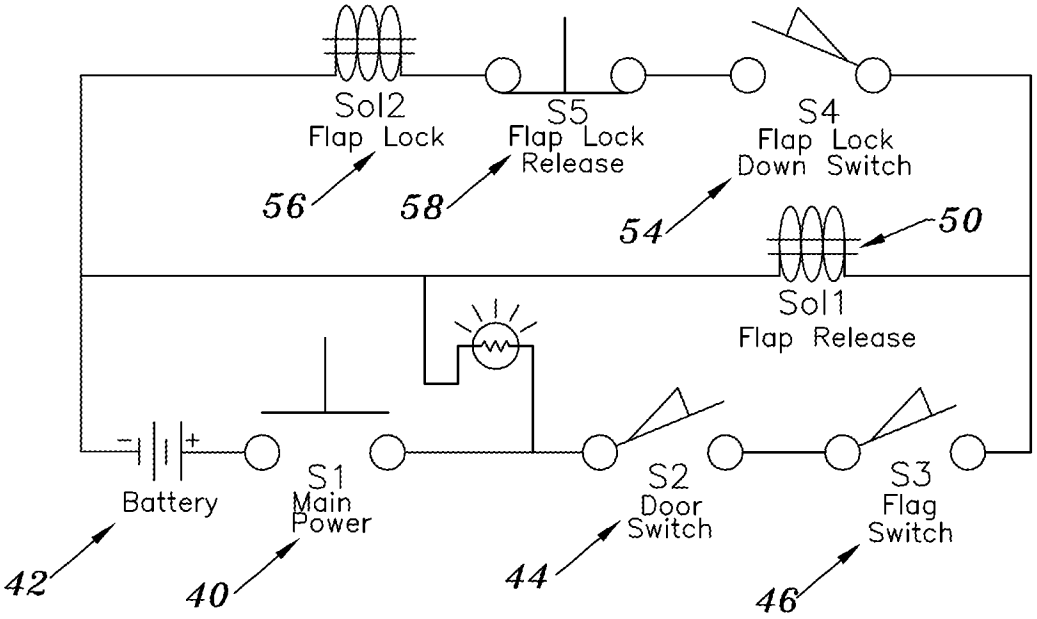
FIG. 3 is an electrical schematic of an exemplary triggering system according to the present disclosure.

With further reference to FIGS. 1 and 2, electronic aspects of the exemplary shielding mechanism are schematically depicted. In addition, FIG. 3 schematically depicts electronic architecture/circuitry of an exemplary electronic system according to the present disclosure. In particular, a main power switch 40 is mounted with respect to rear wall 20 of housing 12. It is noted that main power switch 40 may be located in various locations, e.g., protruding downwardly from the based 14, but outward extension of main power switch 40 from rear wall 20 provides a readily accessible and non-observed location for general use of the disclosed mailbox 10. A battery 42 is generally associated with rear wall 20 in close proximity to main power switch 40, although as with the main power switch, the precise location of battery 42 is not critical to the design and/or operation of the disclosed mailbox. Battery 42 is selected so as to provide appropriate voltage to the electronic system disclosed herein and may be rechargeable, as is known in the art.

A door interlock switch 44 is positioned on the partial front wall 18 and extends outward so as to cooperate with door 24. Specifically, as door 24 is closed, it engages the door interlock switch 44 which, based on the circuitry schematically depicted in FIG. 3, makes all features and mechanisms associated with the shielding mechanism of the mailbox inoperable. This interlock functionality helps to prevent operation of the disclosed shielding mechanism from being discovered. When the door 24 is opened—with the main power switch 40 powered on—the interlock switch 44 is released, thereby delivering power to a flag switch 46 that is mounted relative to the curved top face 16 of housing 12 in proximity to flag 26. Interlock switch 44 is normally open.

Turning to the design and operation of the exemplary shielding mechanism depicted in FIGS. 1-6, when a user of the disclosed mailbox 10 is ready to "mail" or "send" a letter, the user places the letter in the internal volume 22 of mailbox housing 12 and closes the door 24, thereby engaging interlock switch 44. The flag 26 is raised, i.e., pivoted or rotated upward, which in turns rotates a lever or actuator 47 which causes the flag switch 46 to close. When closed, the flag switch 46 delivers power to a flag switch solenoid 50 (sol 1). When the flag switch solenoid 50 energizes, it actuates a mechanical mechanism 48 that causes latching arm 34 to pivot and detaches latching finger 32 from its engagement with a top edge of false floor 28. The design/operation of mechanical mechanism 48 may take various forms, as will be readily apparent to persons skilled in the art. In the exemplary embodiment depicted in FIG. 2, flag switch solenoid 50 translates into upward motion of an associated leg 47 which cooperates with a translational pivotal element 49 (mounted in a stationary yoke), which translates upward motion of leg 47 into rotational motion of latching arm 34.

Figure 6:
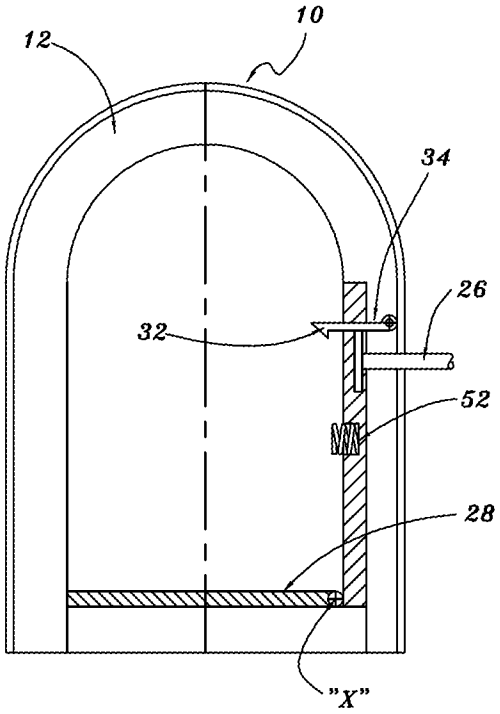
FIG. 6 is an end view of the exemplary mailbox of FIGS. 4 and 5 showing the exemplary shielding mechanism at the end of its travel after covering and thereby hiding a letter according to the present disclosure.
Figure 5:
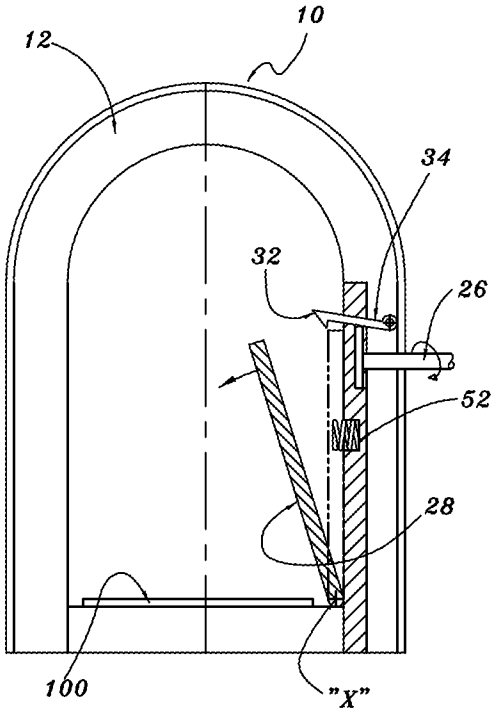
FIG. 5 is an end view of the exemplary mailbox embodiment of FIG. 4 at the point of activation of an exemplary shielding mechanism that will function to obscure a letter from view according to the present disclosure.
Figure 4:
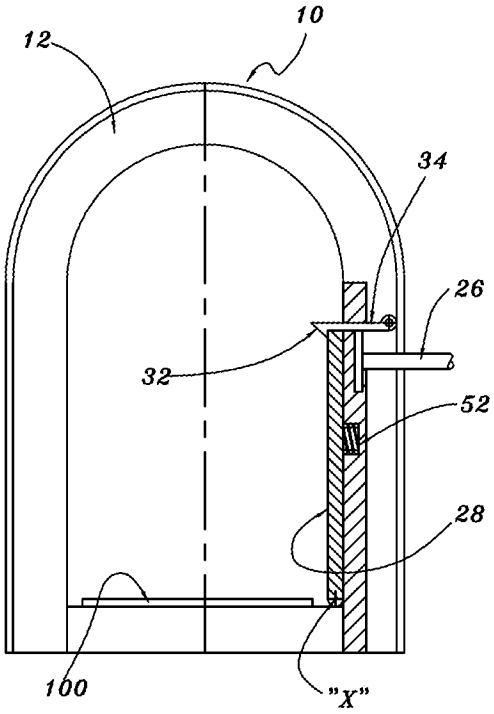
FIG. 4 is an end view of an alternative mailbox, with door removed for ease of viewing and partially in cross section of the device, wherein the mailbox is "loaded" and ready to accept a letter according to the present disclosure.

Of note and with reference to FIGS. 4-6, when the false floor 28 is in its latched and non-deployed orientation (as shown in FIG. 4), a boost spring 52—which is fixedly mounted with respect to an internal surface of housing 12—is loaded in compression. When the latching finger 32 is released from engagement with false floor 28 (as shown in FIG. 5), boost spring 52 releases its compressive preload and pushes the false floor away from the inner surface of housing 12. Inclusion of a boost spring 52 or like biasing mechanism is optional according to the present disclosure, but may serve the advantageous function of ensuring a desired rotation of a de-latched false floor to its deployed, i.e., shielding, orientation in a reliable and prompt manner.

As shown in FIGS. 5 and 6, the de-latched false floor 28 rotates downward in a counter-clockwise manner (for the orientation shown in FIGS. 5 and 6) under the force of gravity. As shown in FIG. 6, the false floor 28 rotates into a horizontal (or substantially horizontal) orientation, such that letter 100 is hidden from view below false floor 28. Of note, housing 12 may define a ledge along the horizontal axis opposite the axis "X" about which the false floor 28 pivots, thereby ensuring that (i) the false floor 28 rests in a substantially horizontal orientation when downward motion is complete and (ii) a region is defined below false floor 28 (in the orientation of FIG. 6) to accommodate letter 100. Of further note, it may be desirable to include a noise buffering element, e.g., felt, along the surface that the false floor 28 engages as it reaches its horizontal configuration so as to reduce the likelihood that a user may hear the contact there between. It may also be desirable to include small hole(s) in the false floor 28 to permit limited air passage therethrough, thereby reducing the resistance to downward rotation of the false floor 28.

In the exemplary embodiment of FIGS. 1-6, when the false floor 28 reaches the horizontal orientation (as shown in FIG. 6), false floor 28 engages a flap closed switch 54 that is upwardly directed from the base 14 of housing 12 (see FIG. 2), thereby closing switch 54. When closed, flap closed switch 54 immediately provides power to flap locking solenoid 56 (sol 2), as also shown in FIG. 2, which pushes flap lock 55 into a position to prevent the false floor 28 from moving further. According to exemplary embodiments of the present disclosure, the false floor 28 remains locked closed until the main power is turned off or an optional flap lock release switch 58—which may protrude from rear wall 20—is pushed/activated. Thus, the operations of switch 54, solenoid 56, lock 55 and release switch 58 cooperate to secure false floor 28 in a horizontal orientation unless/until the release switch 58 is activated, thereby permitting the false floor 28 to be repositioned, e.g., returned to its vertical/latched orientation (as shown in FIG. 4), and the letter 100 to be retrieved from below the false floor 28. A flap release lever 53 may also be provided to facilitate release of false floor 28 from a horizontally locked orientation.

As described herein with reference to the exemplary embodiment of FIGS. 1-6, the shielding mechanism generally includes, at a minimum, false floor 28, latch mechanism 30 and an electronic release mechanism that is triggered through interaction with mailbox 10, e.g., the electronics that serve to activate solenoid 50. Of note, ancillary elements of the exemplary mailbox 10 of FIGS. 1-6, e.g., boost spring 52, switch 54, solenoid 56, lock 55 and release switch 58, are not required for implementation of an operational shielding mechanism according to the present disclosure.

Figure 7:
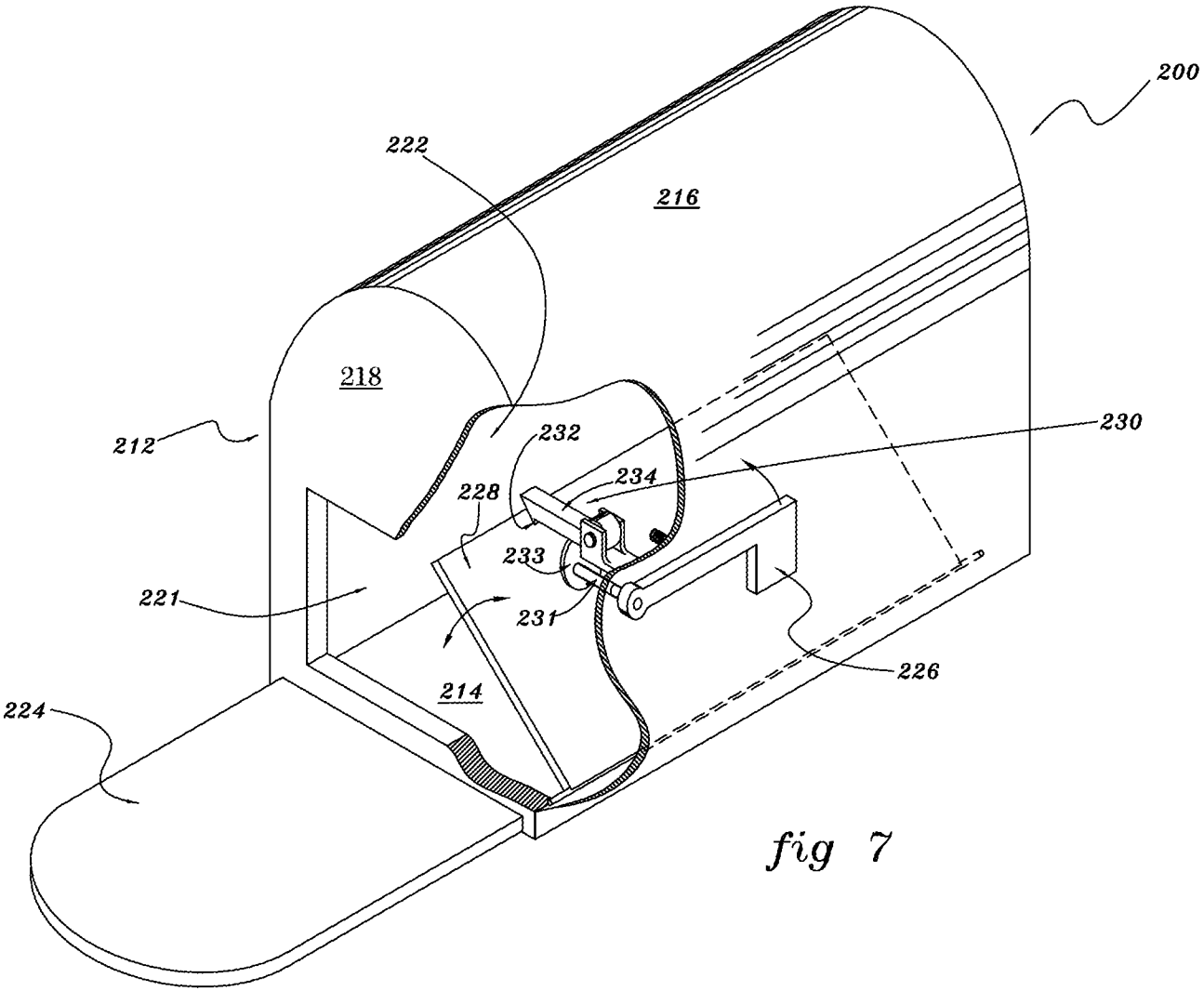
FIG. 7 is a front view isometric drawing of FIGS. 4-6, with a portion of the outer mailbox repository removed to permit viewing of internal elements, according to the present disclosure.

Turning to FIG. 7, an alternative mailbox 200 is schematically depicted according to the present disclosure. As with mailbox 10 described herein above, mailbox 200 includes mailbox housing 212 that is defined by a base 214, a curved top face 216, a partial front wall 218 and a rear wall (not shown). The partial front wall 218 defines an opening 221 that is configured and dimensioned to allow introduction/withdrawal of object(s), e.g., letter(s), relative to an internal volume 222 defined by housing 212. A door 224 is hingedly mounted relative to housing 212 and is movable between an open position (as shown in FIG. 7) and a closed position wherein the door 224 is in abutting relation to partial front wall 218. A flag 226 is pivotally mounted with respect to an external surface of curved top face 216 of housing 212.

With further reference to FIG. 7, flag 226 is mounted with respect to a rod 231 that extends through a side surface of curved top face 216 and engages a latching mechanism 230 positioned internal to housing 212. More particularly, in the exemplary embodiment of FIG. 7, latching mechanism 230 includes a cam element 233 to which rod 231 is mounted/joined at a non-centric point thereof. As flag 226 is rotated counter-clockwise (in the orientation shown in FIG. 7) to "raise the flag" relative to mailbox 200, the cam element 233 is rotated into engagement with latching arm 234 of latch mechanism 230, thereby pivoting the latching arm 234 upward and releasing latch finger 232 from engagement with a top edge of false floor 228. Once latching finger 232 is released from latching engagement with false floor 228, false floor 228 rotates downward under the force of gravity so as to assume a substantially horizontal orientation, thereby shielding from view any object(s), e.g., a letter, positioned on the base 214 of mailbox 200. Thus, the exemplary mailbox 200 illustrates an exemplary implementation of a shielding mechanism that is actuated/controlled using an entirely mechanical design (as compared to the electronics that facilitate operation of the shielding mechanism disclosed in the embodiment of FIGS. 1-6). As will be readily apparent to persons of ordinary skill in the art, alternative cam and/or lever mechanisms may be employed to provide a desired triggering action based on rotation of the flag to thereby release the false floor. In addition, mechanical interlock mechanisms may be provided that are responsive to the positioning of door 224, i.e., similar in function to the electronic switch 44 associated with mailbox 10, as well as false floor locking mechanisms, i.e., similar in function to the switch 54, solenoid 56, lock 55 and release switch 58 described with reference to mailbox 10.

In the various embodiments of the present disclosure, it is contemplated that the false floor may be advantageously locked in a deployed/horizontal configuration until reset by a user. Thus, once the shielding mechanism cycle is complete and the child is no longer interacting with the disclosed mailbox, the parent or other individual may remove the letter from below the false floor and "reload" the device to be used again. The parent/guardian could at this point insert a "return" letter from Santa to further the illusion. It is further contemplated that a responsive letter may be introduced through a slot defined in the rear wall of the mailbox so as to be positioned between the false floor and the side wall of the mailbox, such that the responsive letter may automatically "appear" when the false floor rotates into the horizontal orientation.

Thus, the mailboxes of the present disclosure advantageously encourage interaction of young children and parents/adults/siblings during the Christmas season. Although the present disclosure has been described with reference to model mailboxes with built in mechanisms that allow the device to give the illusion of a letter written to Santa "magically" being delivered to the North Pole, i.e., disappearing when placed within a mailbox/repository, alternative implementations are specifically contemplated, e.g., a disappearing tooth that could be delivered to the tooth fairy, a disappearing letter to friends/relatives with birthday gift suggestions, and the like. The repository need not take the form of a mailbox, but may instead be designed as another illusion-supporting repository, e.g., a bee hive, a coin box, and the like.

In further exemplary embodiments, a children's illustrated book coinciding with use of the disclosed mailbox/repository may be provided to explain the purpose and function of the apparatus/system and how it encourages repeated use and interaction with parent(s) and others throughout the holiday season.

Although the present disclosure has been described with reference to exemplary embodiments thereof, the present disclosure is not limited by or to such exemplary embodiments. Rather, the present disclosure may be modified, enhanced or refined without departing from the spirit or scope of the present disclosure. All such modifications, enhancements and/or refinements are encompassed by the present disclosure, as will be apparent to persons skilled in the art from the description provided herein.

The invention claimed is:

1. A repository that supports an illusion, comprising:

a. a housing that includes a base, one or more side walls, a rear wall and a door that is movable between an open and a closed position, the housing defining an internal volume;

b. a triggering mechanism associated accessible outside of the housing;

c. a false floor that is movable between a non-deployed and a deployed orientation in response to action of the triggering mechanism, wherein the false floor shields from view an object placed on the base of the housing when in the deployed orientation, wherein the repository is a mailbox, wherein the triggering mechanism includes a flag that is movably mounted with respect to an external surface of the housing, wherein the movement of the flag causes the triggering mechanism to release a latching mechanism that releasably maintains the false floor in the non-deployed orientation, and wherein movement of the flag actuates a solenoid that releases the latching mechanism.

2. The repository of claim 1, wherein the housing further includes a partial front wall that defines an opening to the internal volume of the housing, and wherein the door is configured and dimensioned to move into the closed position that covers the opening.

3. The repository of claim 2, further comprising (i) a battery mounted with respect to the housing, and (ii) a door interlock switch that is engaged when the door is moved to the closed position.

4. The repository of claim 1, further comprising an opening in the rear wall that is sized and configured to permit introduction of an object between the false floor and the housing when the false floor is in the non-deployed orientation.

5. A repository that supports an illusion, comprising:

a. a housing that includes a base, one or more side walls, a rear wall and a door that is movable between an open and a closed position, the housing defining an internal volume;

b. a triggering mechanism associated accessible outside of the housing;

c. a false floor that is movable between a non-deployed and a deployed orientation in response to action of the triggering mechanism, wherein the false floor shields from view an object placed on the base of the housing when in the deployed orientation, wherein the repository is a mailbox, wherein the triggering mechanism includes a flag that is movably mounted with respect to an external surface of the housing, wherein the movement of the flag causes the triggering mechanism to release a latching mechanism that releasably maintains the false floor in the non-deployed orientation, and wherein movement of the flag actuates a cam element that releases the latching mechanism.

6. The repository of claim 5, wherein the housing further includes a partial front wall that defines an opening to the internal volume of the housing, and wherein the door is configured and dimensioned to move into the closed position that covers the opening.

7. The repository of claim 6, further comprising (i) a battery mounted with respect to the housing, and (ii) a door interlock switch that is engaged when the door is moved to the closed position.

8. A repository that supports an illusion, comprising:

a. a housing that includes a base, one or more side walls, a rear wall and a door that is movable between an open and a closed position, the housing defining an internal volume;

b. a triggering mechanism associated accessible outside of the housing;

c. a false floor that is movable between a non-deployed and a deployed orientation in response to action of the triggering mechanism, and d. a spring that applies a biasing force to the false floor to urge movement of the false floor to the deployed orientation, wherein the false floor shields from view an object placed on the base of the housing when in the deployed orientation.

9. The repository of claim 8, wherein the housing further includes a partial front wall that defines an opening to the internal volume of the housing, and wherein the door is configured and dimensioned to move into the closed position that covers the opening.

10. The repository of claim 9, further comprising (i) a battery mounted with respect to the housing, and (ii) a door interlock switch that is engaged when the door is moved to the closed position.

11. A repository that supports an illusion, comprising:

a. a housing that includes a base, one or more side walls, a rear wall and a door that is movable between an open and a closed position, the housing defining an internal volume;

b. a triggering mechanism associated accessible outside of the housing;

c. a false floor that is movable between a non-deployed and a deployed orientation in response to action of the triggering mechanism, wherein the false floor shields from view an object placed on the base of the housing when in the deployed orientation, wherein the housing defines a ledge, wherein the false floor engages the ledge when in the deployed orientation, and wherein the ledge includes a sound buffering element mounted with respect thereto.

12. The repository of claim 11, wherein the housing further includes a partial front wall that defines an opening to the internal volume of the housing, and wherein the door is configured and dimensioned to move into the closed position that covers the opening.

13. The repository of claim 12, further comprising (i) a battery mounted with respect to the housing, and (ii) a door interlock switch that is engaged when the door is moved to the closed position.

14. A repository that supports an illusion, comprising:

a. a housing that includes a base, one or more side walls, a rear wall and a door that is movable between an open and a closed position, the housing defining an internal volume;

b. a triggering mechanism associated accessible outside of the housing;

c. a false floor that is movable between a non-deployed and a deployed orientation in response to action of the triggering mechanism, and d. a locking mechanism that releasably locks the false floor in the deployed orientation, wherein the false floor shields from view an object placed on the base of the housing when in the deployed orientation.

15. The repository of claim 14, wherein the locking mechanism includes a solenoid actuator.

16. The repository of claim 14, wherein the housing further includes a partial front wall that defines an opening to the internal volume of the housing, and wherein the door is configured and dimensioned to move into the closed position that covers the opening.

17. The repository of claim 16, further comprising (i) a battery mounted with respect to the housing, and (ii) a door interlock switch that is engaged when the door is moved to the closed position.

18. A method for creating an illusion with respect to disappearance of an object, comprising:

a. providing a repository that defines an internal volume and a false floor that is releasably latched in a non-deployed orientation;

b. placing an object within the internal volume of the repository;

c. engaging a triggering mechanism that unlatches the false floor, whereby the false floor moves to a deployed orientation that shields from view the object within the internal volume of the housing, wherein the repository is a mailbox, wherein the triggering mechanism is a flag mounted with respect to the mailbox, and wherein the triggering mechanism actuates an electronically-controlled latching mechanism.

19. The method of claim 18, wherein the object is a letter.

20. The method of claim 18, wherein the object is a letter addressed to Santa.

* * * * *